US006964174B2

(12) United States Patent
Shah

(10) Patent No.: US 6,964,174 B2
(45) Date of Patent: Nov. 15, 2005

(54) METHOD AND SYSTEM FOR DETERMINING RELATIVE DUCT SIZES BY ZONE IN AN HVAC SYSTEM

(75) Inventor: Rajendra K. Shah, Indianapolis, IN (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/932,179

(22) Filed: Sep. 1, 2004

(65) Prior Publication Data

US 2005/0155367 A1 Jul. 21, 2005

Related U.S. Application Data

(60) Provisional application No. 60/537,524, filed on Jan. 20, 2004, provisional application No. 60/537,717, filed on Jan. 20, 2004.

(51) Int. Cl.[7] ..... F24F 7/00; F24F 3/00; G01K 13/00; F25D 17/04

(52) U.S. Cl. ..... 62/129; 62/186; 236/49.3; 165/205

(58) Field of Search ..... 62/129, 186; 236/49.3; 165/205, 208, 212

(56) References Cited

U.S. PATENT DOCUMENTS 4,549,601 A * 10/1985 Wellman et al. ..... 165/205
4,948,040 A * 8/1990 Kobayashi et al. ..... 236/49.3
5,573,181 A * 11/1996 Ahmed ..... 236/49.3

* cited by examiner

*Primary Examiner*—Chen Wen Jiang
(74) *Attorney, Agent, or Firm*—Carlson, Gaskey & Olds

(57) ABSTRACT

A control and method are disclosed to determine the relative duct sizes of a plurality of ducts leading to a plurality of zones in a multi-zone HVAC system. In a disclosed method, the dampers leading to each of the zones are operated such that one damper is held more open than the remaining dampers, and a system component is monitored as air is blown through the duct. In particular, a blower speed may be monitored. Once the blower speed is monitored, for one damper being open, with the remaining dampers being relatively closed, another damper is opened and the first is closed. This process continues until relative information is gathered for each of the zones. This relative information is then utilized to determine the relative sizes of the ducts leading to each of the zones as a percentage of the total duct size. The relative duct size information is then utilized to perform various control methods.

9 Claims, 5 Drawing Sheets

METHOD AND SYSTEM FOR DETERMINING RELATIVE DUCT SIZES BY ZONE IN AN HVAC SYSTEM

This application claims priority to provisional patent application Ser. No. 60/537,524, filed Jan. 20, 2004, and entitled "Determination of Relative Duct Sizes by Zone in an HVAC System," and provisional patent application Ser. No. 60/537,717, filed Jan. 20, 2004, and entitled "Method and System for Automatically Optimizing Zone Duct Damper Positions." The disclosure of this provisional application is incorporated herein in its entirety, by reference.

BACKGROUND OF THE INVENTION

This application discloses a method and control for determining the relative sizes of the ducts leading to each of several zones in a multi-zone HVAC system.

Multi-zone HVAC systems are known, and include a component(s) for changing the temperature and condition of air (a furnace, air conditioner, heat pump, etc.). For simplicity, these components will be referred to collectively as a temperature changing component. Also, an indoor air handler drives air from the temperature changing component through supply ducts to several zones within a building. Each of the supply ducts typically have dampers that may be controlled to restrict or allow flow of air into each zone to achieve a desired temperature.

In these systems, sizes of the ducts leading to each of the zones may vary due to restrictions, etc. which could occur along the length of the ducts. Thus, while modern HVAC systems are being adapted for the consideration of sophisticated controls, accurately controlling the flow of air into each of the several zones would require knowledge of the relative sizes of the ducts. As an example, if there were two ducts leading to two zones, with one of the two ducts being smaller than the other, the smaller duct would tend to receive less airflow than the larger duct. Knowledge of the sizes of the ducts is thus important, to provide the ability to achieve close control over airflow to these zones.

However, no method of determining the duct sizes to each of the zones is known in the prior art. At best, an installer could manually measure the duct sizes. However, this would be relatively impractical, and has not been utilized.

SUMMARY OF THE INVENTION

In a disclosed embodiment of this invention, a control performs an initial determination of the relative duct sizes for the ducts leading to each of the zones in a multi-zone HVAC system. This determination can be done initially at system set-up, and should be relatively reliable for the life of the HVAC system. The determination of the zone duct sizes, once complete, can be utilized for various control features such as are disclosed in co-pending U.S. patent application Ser. No. 10/889,735, filed on Jul. 13, 2004, and entitled "Method and System for Automatically Optimizing Zone Duct Damper Positions," and which is generally disclosed in the above-referenced U.S. Provisional Patent Application Ser. No. 60/537,717.

In general, a control opens a damper associated with one of the zones, while maintaining the other dampers in a relatively close position. The system is then able to determine a condition, such as relative static pressure, for each of the zones relative to all others. This information can then be utilized in an iterative process to determine the relative duct sizes for each of the zones. Once the relative duct sizes are known, better control of airflow to each zone can be achieved.

In a further refinement of the disclosed embodiment, the system also determines the airflow characteristics with all dampers believed to be closed. This provides an indication of the amount of leakage across the system, which allows further refinement of the determination of the relative duct sizes.

These and other features of the present invention can be best understood from the following specification and drawings, the following of which is a brief description.

DETAILED DESCRIPTION OF THE PREFERRED EMBODIMENT

While the present invention is directed to the determination of relative duct sizes across a multi-zone system, an example control system for utilizing the duct size information will be disclosed.

Figure 1:
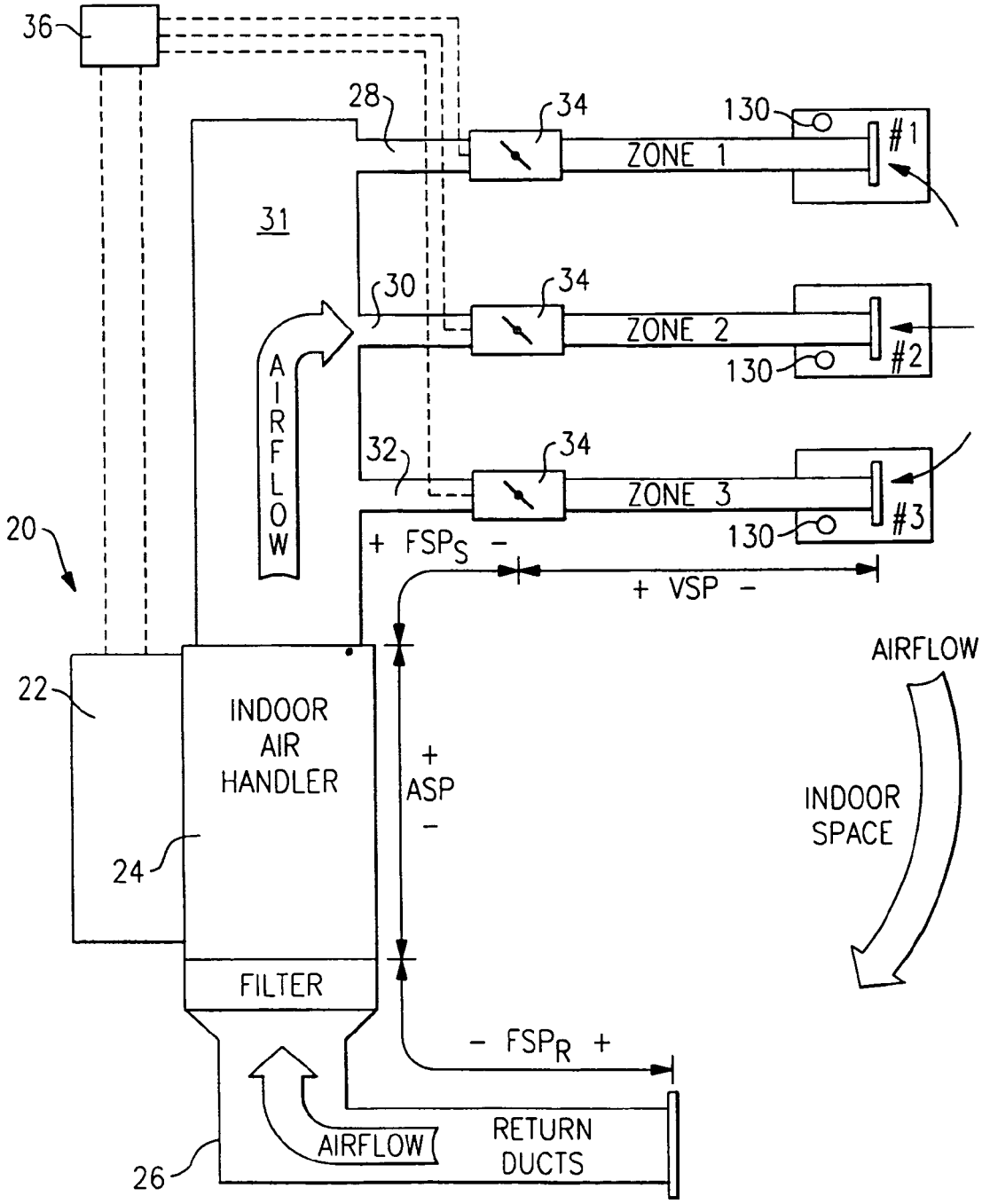
FIG. 1 is a schematic view of a building HVAC system.

A multi-zone HVAC system is shown schematically at 20 in FIG. 1. A temperature changing component 22 for changing the condition of air, e.g., an indoor unit (furnace/heater coil) and/or an outdoor unit (air conditioning/heat pump), is associated with an indoor air handler 24. Air handler 24 takes air from return ducts 26 and drives the air into a plenum 31, and a plurality of supply ducts 28, 30, and 32 associated with distinct zones 1, 2, and 3 in a building. As shown, a damper 34 is provided on each of the supply ducts 28, 30 and 32. A control, such as a microprocessor control 36 controls the dampers 34, temperature changing component 22, indoor air handler 24, and also communicates with controls 130 associated with each of the zones. The controls 130 can essentially be thermostats allowing a user to set desired temperature, noise levels, etc. for each of the zones relative to the others. Moreover, the controls 130 preferably include a temperature sensor for providing an actual temperature back to the control 36.

In one embodiment, the control 36 is mounted within one of the thermostat controls 130, and communicates as a system control with all of the other elements through control wiring schemes such as is disclosed in co-pending U.S. patent application Ser. No. 10/752,626, entitled "Serial Communicating HVAC System" and filed on Jan. 7, 2004. As disclosed, control 36 is able to receive configuring information with regard to each of these system components so that control 36 understands individual characteristics of the elements 22, 24, 30 and 34. Details of this feature may be as disclosed in co-pending U.S. patent application Ser. No. 10/752,628, filed on Jan. 7, 2004 and entitled "Self-Configuring Controls for Heating, Ventilating and Air Conditioning Systems." The disclosure of each of these applications is incorporated herein by reference.

In the prior art, the amount of air driven by the air handler 24 to each of the zones 1, 2 and 3 sometimes become excessive. Dampers 34 may be opened or closed to restrict or allow additional airflow into the zones 1, 2 and 3. While there are dampers that are driven to either be full open or full closed, the present invention is disclosed as used with a damper having not only full open and full closed positions, but also several incrementally closed positions. In one example, there are 16 incremental positions for the damper between full open and full closed. As any one of the dampers 34 is closed to reduce conditioning in that zone, additional airflow is driven to the more open of the dampers. This may sometimes result in too much air being delivered to one of the zones, which can cause excessive temperature change, and undue noise. In the prior art, pressure responsive bypass valves may be associated with the ducting 28, 30, 32 or upstream in plenum 31. The bypass of the air has undesirable characteristics, as it requires additional valves, ducting, etc., and thus complicates assembly. Typically, the bypass air is returned to the temperature changing component 22 through return duct 26. Thus, the air approaching temperature changing component 22 has already been changed away from ambient, and may be too cold or too hot for efficient operation.

For this reason, it would be desirable to find an alternative way of ensuring undue volumes of air do not flow through any of the ducts 28, 30, and 32 into the zones 1, 2, and 3. Of course, in many systems, there may be more or less than three zones. However, for purposes of understanding this invention, three zones will suffice.

Figure 2:
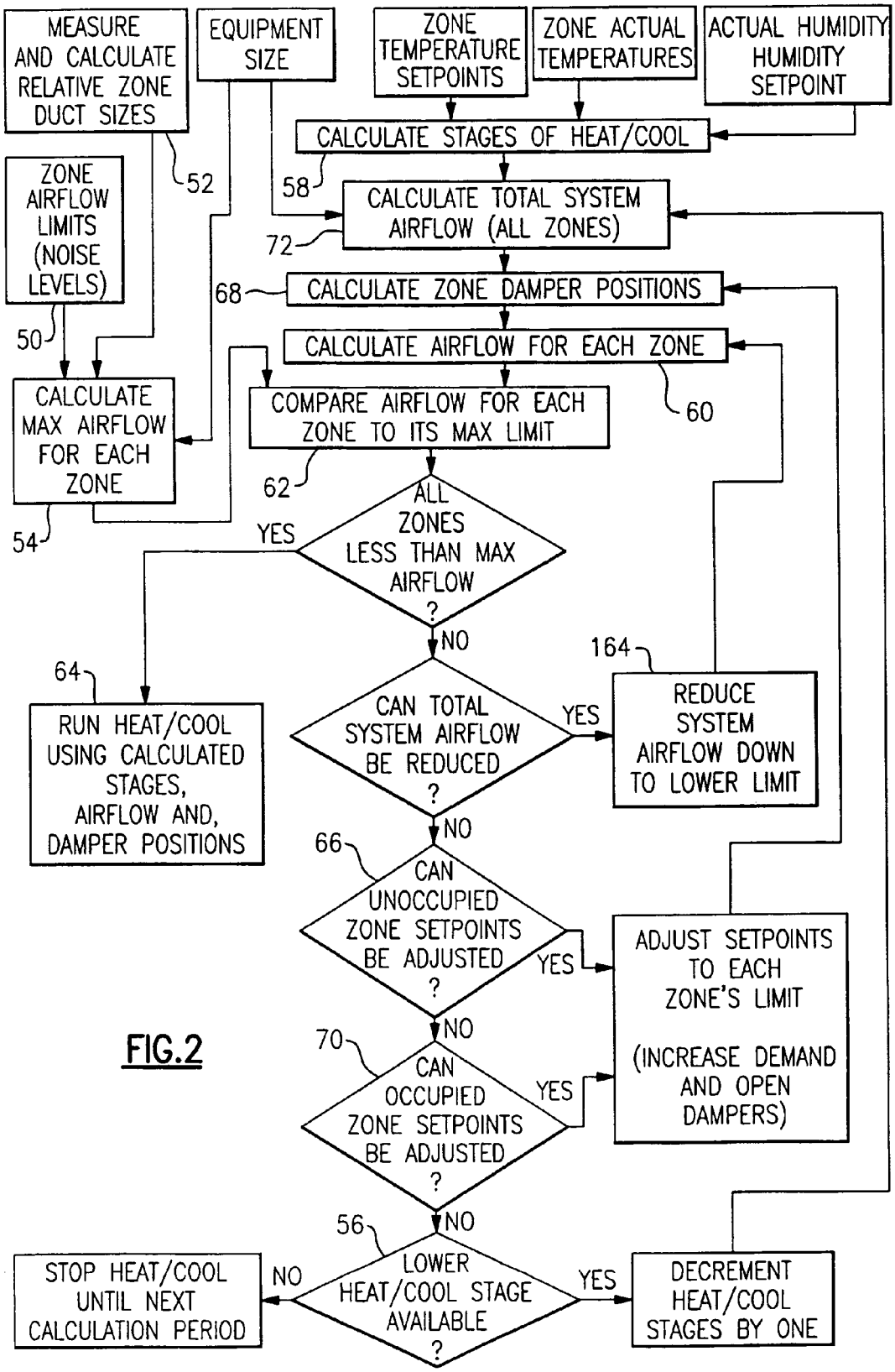
FIG. 2 is a flowchart of the inventive method.

A flowchart of a control for the dampers to eliminate the need for bypass is illustrated in FIG. 2. At step 50, a zone airflow limit is set for each of the zones 1, 2, and 3. The controls 30 may be provided with input settings allowing these limits to be set. For example, the controls 30 may be provided with settings allowing the maximum airflow limit to be LOW, NORMAL, HIGH or MAXIMUM. These settings increase the weighting of allowing additional conditioned air into the zone at the expected cost of potential additional noise as the airflow increases. Thus, a user most concerned about reducing noise might set the control to the LOW level. Also, some factory set default is included. In simpler designs, it may well be that only the default is utilized, and no operator override of this default value is provided.

The invention includes an automatic duct size assessment step 52 orchestrated by control 36, performed shortly after installation of the system in a home, and repeated periodically thereafter. This duct size assessment process consists of a measurement process and a computational process. This duct size assessment process provides a control with information allowing it to improve the efficient and accurate control of airflow throughout the zones.

Figure 3:
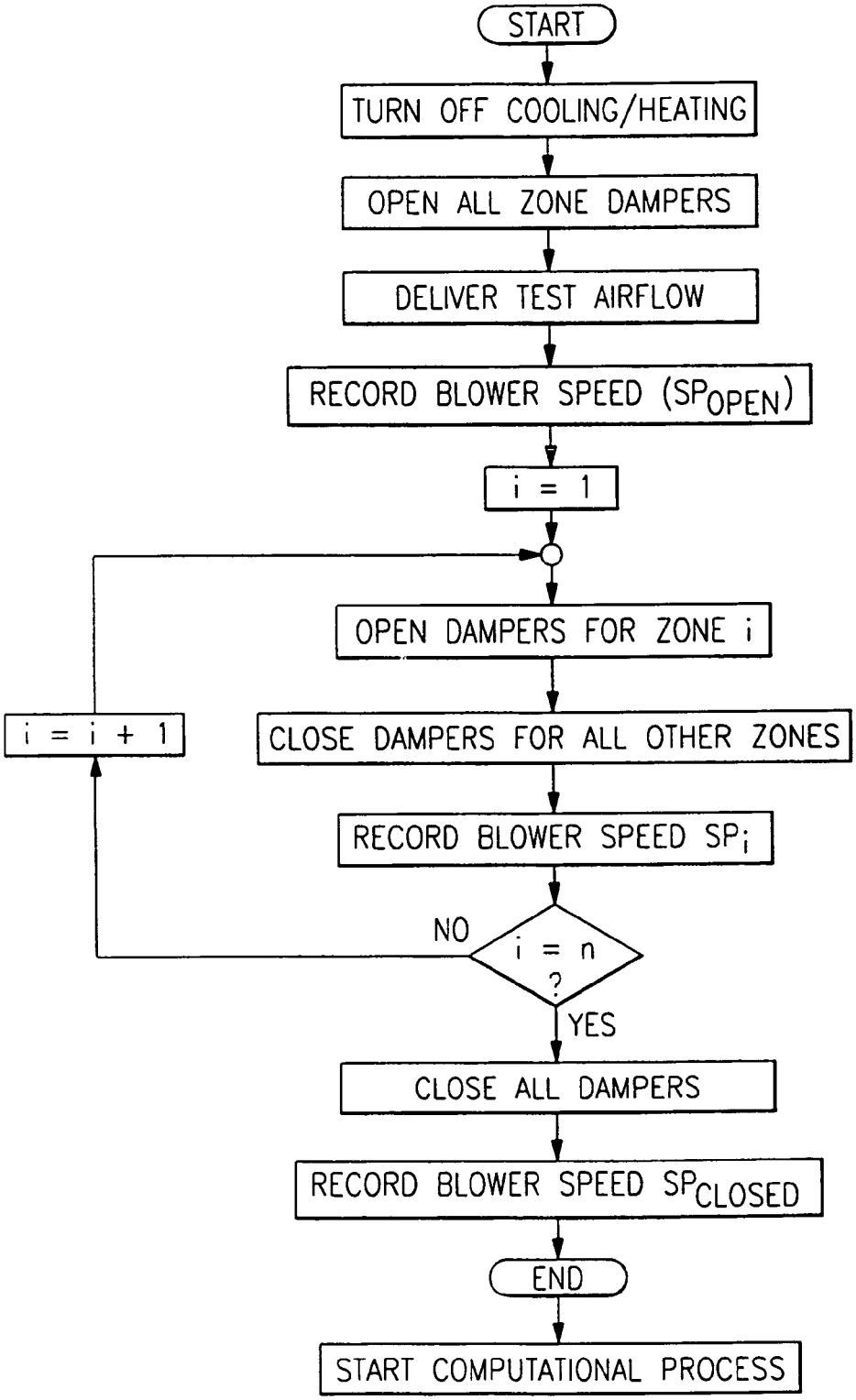
FIG. 3 is a flowchart of one portion of the invention.

In the initial measurement process, the control 36 temporarily turns off temperature changing component 22. This process is generally shown in FIG. 3. Control 36 commands the dampers 34 of all zones to fully open. Control 36 then commands the system air handler 24 to deliver a predetermined fraction of the maximum system airflow (test airflow) into plenum 31 and ducts 28, 30, 32. The air handler 24 determines the speed of its blower motor and communicates this information to control 36, which stores it in a memory. Next, control 36 closes all dampers 34 except for a first zone's. Air handler 24 is still asked to deliver the same test airflow as before, and it reports the new blower motor speed to control 36. The relative blower speeds are indicative of the relative restriction in the ducts, as explained below. In this manner, sequentially, dampers 34 for each zone in the system are opened while all other zone dampers 34 are closed. In each step of this sequence, the same airflow is delivered by air handler 34, and the resulting blower speed is recorded. Finally, all zone dampers 34 are closed and the same test airflow is forced through any leaks in the dampers 34 or in the ducts 28, 30, 32, 34 around them. Again, the blower speed is recorded. Thus, for a system with n zones, a total of n+2 blower speed measurements (SP) are taken;

SPopen for all zones open;

SPclosed for all zones closed; and

SPi for each zone open by itself.

It should be noted that in the above measurement process, instead of fully opening and closing the dampers, they may be partially opened at two different positions. Also, different test airflow levels may be used in different steps of the sequence. These variations, if chosen, can be accommodated by adjusting the computational process shown below. A worker in this art would understand how to adjust the computation to achieve the desired results.

The speed measurements are converted to duct static pressure measurements as shown below. This embodiment has some benefits, as it is sensorless. An alternative is to substitute direct duct pressure measurement instead of the speed measurement using an economical and reliable pressure transducer.

Figure 4:
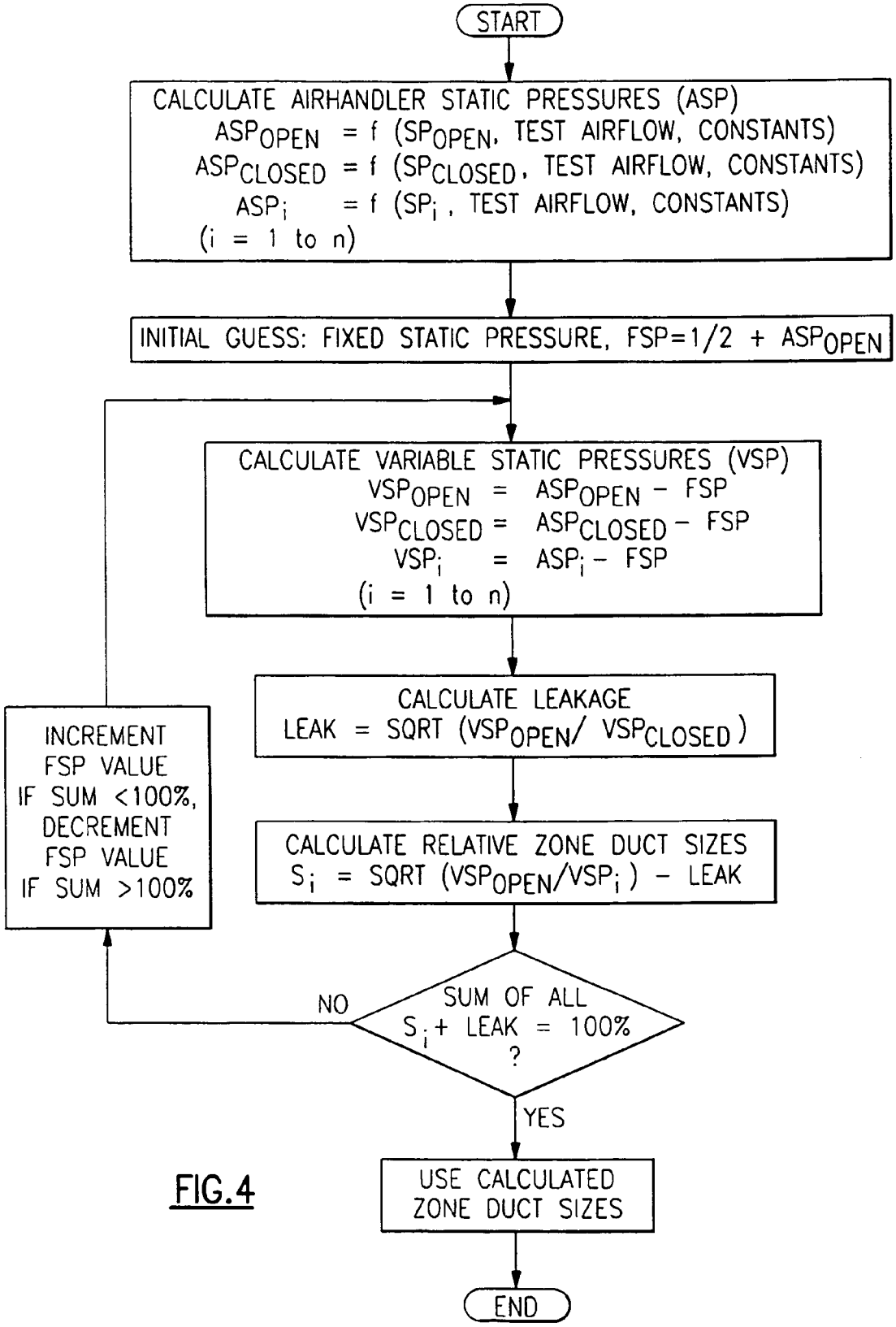
FIG. 4 is a flowchart of a step subsequent to the FIG. 3 flowchart.

A computational process to determine duct size is shown in FIG. 4. Initially, a series of air handler static pressures (ASP) are determined based upon the blower speeds. An algorithm for determining these static pressures is disclosed in co-pending U.S. patent application Ser. No. 10/426,463, filed Apr. 30, 2003 and entitled "Method of Determining Static Pressure in a Ducted Air Delivery System Using a Variable Speed Motor." The entire disclosure of this application is incorporated herein by reference, and in particular, the algorithm to determine static pressures across a system is incorporated. The algorithm relates the static pressure developed across air handler unit 24 (from its inlet to its outlet) to 1) the airflow delivered by it, 2) the speed of its blower motor and 3) predetermined constants depending on the physical characteristics of the air handler.

As mentioned above, the control 36 receives initial configuration information on all of the responsive components in system 20. During this self-configuration, and perhaps during installation of the system, the air handler unit 24 communicates with control 36 and provides its characteristic constants. The system control uses the formula in the above application, including unit characteristic constants of air handler unit 24, a commanded airflow and a measured blower speed to compute the static pressure across the air handler unit. As shown in FIG. 4, these calculations (based upon the blower speeds) are repeated with all dampers 34 open and closed, and then each one with only one open. This results in n+2 computed values of ASP, one for each measurement. These are labeled ASPopen, ASPclosed, ASP1, ASP2 . . . ASPn. In an alternate implementation, a control at air handler unit 24 itself can do the same computation and communicate the computed static pressures to control 36.

Another principle utilized in the computation is the well-known "square law," that relates the static pressure across any duct segment or passive equipment unit to the airflow through it. The law states that the static pressure varies as the square of the airflow. This law, while a simplification of the more complex relationships between the variables, has been proven to be generally valid at the air velocities used in residential systems.

The ASP values are utilized to calculate fixed static pressure (FSP) values. As seen in FIG. 1, the static pressure developed across air handler unit 24 is dropped across any external equipment units that the airflow passes through (such as filters and external air conditioning coils) and the entire duct system, both supply side 28, 30, 31, 32 and return side 26. Each zone's dampers 34 control the segment of the supply duct that delivers air to the zone. In this disclosed system, there are no dampers in return ducts 26. Therefore, the return ducts, the external equipment units and the supply ducts prior to the dampers constitute the "fixed" part of the system, through which the full system air is always flowing. This means that, for the same system airflow, the combined pressure drop across these elements, the Fixed Static Pressure (FSP), is the same, regardless of damper positions. Thus, the FSP is the same for all n+2 measurements. This FSP is itself an unknown to be determined by the computation process.

A quality known as variable static pressure (VSP) is a static pressure across the supply duct segments, across and downstream of dampers 34. The VSP values vary as the measurement process directs the same system airflow through duct segments of differing relative size for each zone. Since pressures need to equalize over the complete loop (air handler, supply side, indoor space, return side), for each measurement step:

$$ASP=FSP+VSP$$

The VSP in any measurement step is indicative of the size of the duct segments that are open. The more restrictive a duct segment is (smaller size), the higher will be the static pressure (VSP) across it for the same system airflow. Thus, the duct segment size is inversely related to the VSP. Duct segment size is conveniently computed in terms of airflow capacity, so as to easily determine its fair share of the entire system airflow. For this reason, utilizing the square law relationship between airflow and pressure mentioned above, duct segment size is inversely proportional to the square root of the VSP. The present need is to determine the relative size of a duct segment, each zone's duct size is computed as a fraction (or percentage) of the entire supply duct system (all zones). Thus, the relative duct size for zone i, labeled SLi is computed as:

$$SLi=SQRT(VSPopen/VSPi)$$

To increase accuracy, the inventive system identifies system leakage. Even with all dampers 34 closed, air can still flow. This is because the dampers 34 are not perfect and some air may leak through. Also, the ducts 31, 28, 30, 32 may also have leaks. In some homes, this leakage can be significant. That is why a last measurement with all dampers closed is taken. The "relative size" leakage can be computed exactly as above:

$$LEAK=SQRT(VSPopen/VSPclosed)$$

Since the leakage effectively adds to the apparent size of each zone's duct segments, it needs to be subtracted out. Thus, the corrected zone duct sizes are:

$$Si=SLi-LEAK$$

The above computation used the ASP values. However, to compute the corresponding VSP values one must determine the FSP value and then use the equation:

$$ASP=FSP+VSP$$

Figure 5:
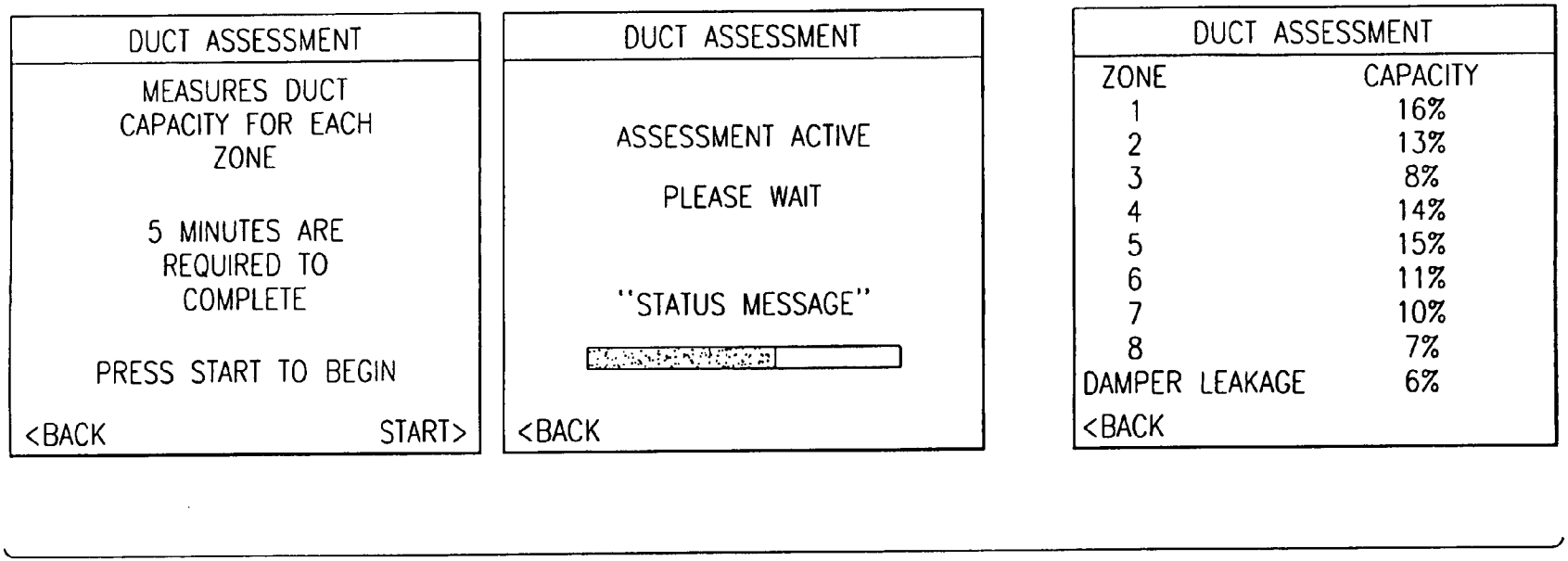
FIG. 5 shows exemplary displays at a control.

Modeling the full duct system and applying the square law and other relationships results in a very complex mathematical model and the need to solve multiple non-linear algebraic equations. Instead, an aspect of this invention is to start with an "initial guess" for the value of the FSP. Then from the already computed ASP values, the corresponding VSP values can be computed. Then, with the above equations, the relative sizes for each zone and the leakage size can be computed. Since all these sizes are percentages of the fully open duct system, these percentages must add up to 100%. Using a computer iterative routine as shown in FIG. 4, the value of FSP is repeatedly adjusted until all zone sizes plus the leakage size add up to 100%. At that point, the correct values of FSP and all the zone relative sizes are determined. FIG. 5 shows the display screens on control 36 during the duct size assessment process and results displayed at the end of the process.

At this point, step 52 is complete and control 36 has calculated the relative zone duct sizes for the zone ducts 28, 30, and 32. Once this computation of the relative zone duct sizes has been complete, it should be relatively reliable for the life of the system. Even so, it may be repeated periodically.

In addition, while the above-referenced inventive way of determining the air handler static pressures (i.e., the algorithm disclosed in the above-referenced co-pending patent application) other known methods to determine the static pressure, such as manually taking pressure measurements with pressure gauges, etc., may also be utilized within the scope of this invention.

Returning to FIG. 2, at step 54, these size quantities, along with information on the size and capacity of the temperature changing component 22, and the setting (step 50) are utilized to calculate a maximum airflow value for each of the zones (1, 2, 3).

The computation of maximum airflow for each zone is completed by the following analysis. A highest system airflow value is determined by assuming that the duct system for the whole house (all zone dampers fully open) is designed to accommodate the highest system airflow required to operate the temperature changing component 22 that is installed in the home. Control 36, through the self-configuration process, knows capacities and airflow requirements of temperature changing component 22 (the installed furnace, air conditioner or heat pump). From this, control 36 computes a highest system airflow (HAS).

In one embodiment:

$$HAS=\text{the higher of } x\ CFM/TON \text{ or } y^{*}\text{High Furnace Airflow.}$$

"CFM" or cubic feet per minute is the unit measure for airflow. The capacity of air conditioners and heat pumps is typically measured in TONs. In one embodiment, x=450 and y=1.12. Of course, different numeric factors for x and y may be used in this computation.

A highest zone airflow is then determined. Again, the duct size assessment allows this determination to be made. With all dampers fully open, each zone gets a share of the total system airflow depending on the "relative size" of the duct segments delivering air to that zone. "Relative size" of a duct segment is a measure of its ability to allow more or less air to flow through it at a certain system pressure. Thus, a zone with a larger duct size will get a higher share of the system airflow than a zone with a smaller duct size. Control 36 has determined the relative duct sizes for all zones in the system. These relative sizes may be expressed as a percentage of the whole duct system and labeled S1, S2, S3 . . . Sn, where n is the number of zones in the system. Then, for each zone, the Highest Zone Airflow (HZAi) is computed as:

$$HZAi=Si^{*}HAS \text{ for } i=1 \text{ to } n.$$

It should be noted that HZAi is the highest expected airflow in each zone with all zone dampers fully open, as if the system was not zoned.

A MAX Zone airflow limit is then determined. In a zoned system, as dampers 34 open and close to redistribute air among the different zones to match their changing heating or cooling needs, any particular zone can, at times get more than its "fair share" of the system airflow. This enables the zone system to deliver a higher level of comfort to occupants of the zone. However, as the airflow increases, at some point, the air noise in the zone may be unacceptable. There is, therefore, a need for a MAX airflow limit for each zone. To some degree, this balance between comfort and noise is a subjective decision depending on the preferences of the occupants. However, to minimize the need for installer or homeowner adjustments and to make the system set-up easy and consistent, control 36 "scales" the MAX zone airflow (MZA) limit to the highest zone airflow computed above. In one embodiment, a user (occupant or installer) can select one out of four Airflow Limits for each zone: LOW, NORMAL, HIGH and MAXIMUM. This is provided as an option at control 130 and/or 36. In one embodiment, the MAX Zone Airflow limits are computed as:

| Selection | MZAi |
|---|---|
| LOW | HZAi |
| NORMAL | 1.5 * HZAi (This may be the Factory Default) |
| HIGH | 2 * HZAi |
| MAXIMUM | 2 * HZAi |

The MAXIMUM selection has the same airflow limit as HIGH, and is used to reduce system airflow and adjust set points if possible as explained below. However, if adjustment is not possible, with the MAXIMUM setting, the heating or cooling stages (step 56, explained below) are never reduced. Comfort in a zone with MAXIMUM airflow limit is achieved even if noise may be unacceptable.

As mentioned, each of the zones (1, 2, 3) allows an operator to set a desired temperature set point at control 130. Further, the control 130 provides the actual temperature at each of the zones, along with an actual humidity, and a humidity set point if the system is so sophisticated. At step 58, control 36 calculates a desired stage of heating/cooling. One way of calculating the desired stage of heating or cooling is disclosed in U.S. patent application Ser. No. 10/760,664, filed on Jan. 20, 2004 and entitled "Control of Multi-Zone and Multi-Stage HVAC System." Based upon the equipment size and the stage of heating/cooling, some total system airflow will then be known or can be calculated by control 36. Control 36 is also able to calculate a desired damper position for each of the zones to meet the desired temperature set point in the zone, and in consideration of the actual temperature in each of the zones at that time. The algorithms to perform these computations are all as known in the art.

Then, at step 60, control 36 calculates expected airflow for each zone, by considering the total system airflow, the damper position in each zone and, again, the relative zone duct sizes. The dampers 34 are modulating in that its rotating blade can be controlled to any angular position between open and closed. As mentioned above, in one embodiment, the dampers are controlled to 16 positions, labeled 0 through 15 with 0 being fully closed and 15 being fully open; each position in between is achieved by a step of equal angular movement. The embodiment also assumes a linear relationship between the dampers angular position and its "openness" or relative ability to allow airflow.

With the linear relationship, the relative airflow capability D for each damper position is computed as:

$$D=j/15 \text{ for position } j;\ j=0 \text{ to } 15.$$

Thus for position 15 (fully open), the relative airflow capability is 100% while for position 0 (fully closed) it is 0.

The relationship may also non-linear and laboratory tests may be used to determine this relationship for a particular style of damper, and then used in the following computation.

Control 36 uses relative duct sizes for each zone in the system, labeled S1 through Sn for a system with n zones here again. Control 36 modulates the zone dampers 34 to deliver more or less air to each zone in response to each zone's comfort demand. The control 36 determines the desired damper position and the corresponding damper airflow capability for each zone. These are labeled D1 through Dn. Control 36 also knows the total system airflow As that needs to flow through the entire system. From these values, control 36 computes the fraction of airflow, Ai being delivered to each zone:

$$Ai=As*(Di*Si)/(\text{SUM } (Di*Si) \text{ for } i=1 \text{ to } n))$$

At step 62, control 36 compares the expected airflow for each zone to its maximum limits. If all of the calculated expected zone airflows are less than the maximum airflows for the respective zones, then control 36 goes to step 64, and simply operates the HVAC system.

However, if an expected zone airflow exceeds its maximum airflow, then control 36 asks whether the total system airflow can be reduced. This is generally a function of the design of the temperature changing component, and the air handler. If the total system airflow can be reduced, then it is reduced to a lower limit at step 64, and control returns to step 60 to recalculate the actual airflow for each zone and move back to step 62.

However, if the total system airflow cannot be reduced, then control 36 moves to step 66, where it considers the availability of adjustment for an unoccupied zone. The controls 30 may allow an operator to set whether a zone is unoccupied. For example, rooms that are only used during certain periods of the year may be kept at a less conditioned temperature to reduce the cost of operating the HVAC system 20. If such a room is set as an unoccupied zone in the system 20, then, as part of step 66, control 36 considers providing additional conditioning at that zone.

Normally, the set points for unoccupied zones are set to a minimum temperature for heating (such as 60 degrees) or a maximum temperature for cooling (such as 85 degrees). With these set points, these zones rarely need any cooling or heating and their dampers remain closed. This saves energy and also allows more of the airflow (and capacity) to be delivered to the occupied zones, as needed to achieve their comfort set points. However, if the expected airflow being delivered to an occupied zone exceeds its max airflow limit, the inventive control 36 can open up the dampers of any unoccupied zones so they can absorb some of the airflow. This enables the occupied zone to be comfort conditioned while staying within its desired noise maximum airflow limit. The control 36 accomplishes this by raising the unoccupied zone heating set point or lowering the cooling set point until the demand in the unoccupied zone causes its damper to open. In the disclosed embodiment, a limit is applied to this set point adjustment. The heating set point is not adjusted above the highest heating set point in any (occupied) zone, while the cooling set point is not adjusted below the lowest cooling set point in any zone. In general, dampers 34 in unoccupied zones may also simply be directly opened without adjusting their set points and their temperature may be allowed to be conditioned to any predetermined limit.

Again, if the unoccupied zone set points can be adjusted, this is done, and the system returns to step 68 where the zone damper conditions can be recalculated, and then to steps 60 and 62. If the unoccupied zone set points cannot be adjusted (initially, or anymore), then the system then moves to step 70, where the occupied zone set points are considered for adjustment.

In the disclosed embodiment, if a zone needing heating or cooling is above its maximum airflow limit and all unoccupied zones have been opened to their limits, the control adjusts the set points of other occupied zones in a manner similar to the unoccupied zones in order to direct more airflow to those zones. In one embodiment, the adjustment limit for an occupied heating set point is set no higher than three degrees below the highest heating set point in any zone. Similarly, the adjustment limit for an occupied cooling set point is set no lower than the three degrees above the lowest cooling set point. Again, different limits may be chosen.

If control 36 can adjust an occupied zone set point, this is done. The control 36 then returns to step 68, then steps 60 and 62. However, if this cannot be done, then the system moves to step 56, and considers whether a lower heating or cooling stage is available. If one is available, the system moves into that lower stage, and returns to step 72 to recalculate the total system airflow, and then to steps 68, 60, 62, etc. As mentioned above, if a zone has been set at a MAXIMUM setting, and it is this zone that might be receiving airflow exceeding its maximum airflow, step 56 may not be run.

If no lower stage is available, then heating and cooling may be stopped until the next calculation period. The above calculations are performed on a periodic basis.

Embodiments of this invention have been disclosed. A worker of ordinary skill in the art would recognize that certain modifications would come within the scope of this invention. For that reason, the following claims should be studied to determine the true scope and content of this invention.

What is claimed is:

1. An HVAC system including:

a temperature changing component to change the temperature of air;

ducts to supply air to a plurality of zones and a damper associated with said ducts leading to each of the zones;

a system control controlling said dampers for each of said zones, said control moving said dampers such that information can be determined relative to airflow through each of said ducts relative to the other of said ducts, and said information being utilized to calculate a size of each said duct relative to the other of said ducts.

2. The HVAC system as set forth in claim 1, wherein said information is static pressure information.

3. The HVAC system as set forth in claim 2, wherein said system control further determining static pressure information with all of the dampers closed to determine a leakage value.

4. The HVAC system as set forth in claim 2, wherein said static pressure information is determined by measuring a blower speed for an air handler for moving air from said temperature changing component into said ducts.

5. The system as set forth in claim 2, wherein a variable static pressure is determined for each of the zones by utilizing the static pressure information, and a determination of a fixed static pressure.

6. The HVAC system as set forth in claim 5, wherein said fixed static pressure is initially determined as a guess, that is then refined in an iterative process.

7. The HVAC system as set forth in claim 6, wherein said steps of determining information including determining leakage information that is utilized in said iterative process.

8. A method of determining the relative sizes of ducts in an HVAC system comprising the steps of:

(1) providing a temperature changing component to change the temperature of air, and ducts to supply air to a plurality of zones, and a damper associated with each of said ducts leading to each of said zones, and a system control for controlling said dampers associated with each of said zones, said control also being operable to monitor information of a system component; and (2) closing said dampers associated with each of said zones in a serial fashion to determine a change in said information of said system component as said dampers for each of said zones are open, with the remainder of said dampers for the remainder of said plurality of zones being relatively closed, and utilizing said information from each of said zones to determine a relative duct size for said ducts leading to each of said zones.

9. The method of claim 8, further including the steps of closing all of said dampers, and determining a change in said information to provide an estimate of leakage within said system, and using said leakage in said determination of relative duct size.

* * * * *